US007204369B2

(12) United States Patent
LeBras

(10) Patent No.: US 7,204,369 B2
(45) Date of Patent: Apr. 17, 2007

(54) WRAPAROUND CARTON WITH INCLINED BEAM STRUCTURE AND BLANK THEREFOR

(75) Inventor: Philippe LeBras, Chateauroux (FR)

(73) Assignee: MeadWestvaco Packaging Systems, LLC, Glen Allen, VA (US)

( * ) Notice: Subject to any disclaimer, the term of this patent is extended or adjusted under 35 U.S.C. 154(b) by 365 days.

(21) Appl. No.: 10/648,940

(22) Filed: Aug. 27, 2003

(65) Prior Publication Data

US 2005/0155885 A1 Jul. 21, 2005

Related U.S. Application Data

(63) Continuation of application No. PCT/US02/08007, filed on Mar. 4, 2002.

(30) Foreign Application Priority Data

Mar. 2, 2001 (GB) ..... 0105223.2

(51) Int. Cl.
*B65D 65/00* (2006.01)
*B65D 75/00* (2006.01)
*B65D 5/00* (2006.01)

(52) U.S. Cl. ..... 206/784; 206/431; 206/434; 206/499; 229/103.2

(58) Field of Classification Search ..... 206/427–435, 206/418, 419, 421, 784, 139, 499; 229/89, 229/103.2; 426/106, 108, 119
See application file for complete search history.

(56) References Cited

U.S. PATENT DOCUMENTS 2,764,284 A 9/1956 Arneson
2,817,473 A * 12/1957 Foster ..... 206/434
3,465,877 A * 9/1969 Martin ..... 206/433
3,861,530 A 1/1975 Calvert
3,923,236 A * 12/1975 Calvert ..... 206/434
4,374,562 A 2/1983 Oliff
4,382,506 A 5/1983 Chaussadas
4,416,411 A 11/1983 Desmond et al.
4,880,115 A * 11/1989 Chaussadas ..... 206/427
5,107,986 A * 4/1992 Cooper ..... 206/434
5,484,059 A * 1/1996 Sutherland ..... 206/434
5,682,996 A 11/1997 Le Bras
5,868,308 A 2/1999 Briand
6,568,585 B2 * 5/2003 Marie ..... 206/434

FOREIGN PATENT DOCUMENTS

EP 0133957 A2 3/1985
EP 0172628 A2 2/1986
EP 0972718 A1 1/2000
EP 1070671 A1 1/2001
FR 0 423 399 11/1974
WO 98/33722 8/1998

* cited by examiner

*Primary Examiner*—Mickey Yu
*Assistant Examiner*—J. Gregory Pickett
(74) *Attorney, Agent, or Firm*—Tsugihiko Suzuki

(57) ABSTRACT

A wraparound carton comprises wall panels hingedly interconnected in series, wherein the wall panels include a pair of base wall panels at the opposite end of the blank. One of the base wall panels is connected to an adjacent wall panel through a beam forming portion that includes a bracket panel hingedly connected to the one base wall panel and a pair of support panels both connected to the bracket panel and extending to the adjacent wall panel.

33 Claims, 6 Drawing Sheets

WRAPAROUND CARTON WITH INCLINED BEAM STRUCTURE AND BLANK THEREFOR

This is a continuation of international application No. PCT/US02/08007, filed Mar. 4, 2002, which is hereby incorporated by reference.

BACKGROUND OF THE INVENTION

The present invention relates to a carton and a blank for forming the same. More particularly, the present invention relates to a carton incorporating a beam structure adapted to fit in the recess between interconnected cups or pots of so-called brick packages, for example.

Such groupings may constitute a single pair or any other desired arrangement such as two rows of two packages each, two rows of three, four or five packages each or greater number of rows desired number of containers. Ordinarily, such containers are relatively small and in order to provide for efficient handling during shipment and displays in retail outlets, it is desirable to stack the articles in tiers one above the other.

For the purposes of this application, each cup or pot is considered to represent a separate article. Some cups or pots are subdivided into separate sections (e.g. yoghurt pots in which the flavoring is in a separate section from the yoghurt).

This invention relates particularly to a beam structure which interconnects a carton side or top wall with its base wall such that the longitudinal axis of the beam is inclined relative to the plane of the carton's top wall and engages with a recess between adjacent pots.

Previous beams have required the carton to be applied to an upright article grouping from below. Examples of such cartons are disclosed in EP 0 972 718 A1 to Goossens Beauvais and FR 2 423 399 to Calvert.

One problem of such cartons is that they are incompatible with conventional wraparound packaging machinery in which the carton is applied to the article grouping from above or below and is wrapped around the article grouping.

SUMMARY OF THE INVENTION

The present invention seeks to overcome or at least mitigate the problems of the prior art.

According to a first aspect of the invention there is provided a wraparound carton for packaging two or more articles with a recess defined between adjacent articles, the carton comprising a top wall, a side wall, a base wall and a beam structure arranged to form a tubular structure so as to encircle the article wherein the beam structure is arranged to be placed in the recess and is hingedly interconnected at one end thereof to the base wall.

Preferably the carton is provided with a second side wall and wherein the second end of the beam structure is hingedly connected to the second side wall. More preferably the second end is hingedly connected to the second side wall intermediate the upper edge and the base of the article.

Alternatively, the second end of the beam structure is hingedly connected to the top wall of the carton.

According to an optional feature of this aspect of the invention, the beam structure comprises a pair of support panels hingedly connected along a common longitudinal edge.

The support panels may define therebetween an acute angle to facilitate formation of the beam.

According to another optional feature of this aspect of the present invention, there further comprises a medial panel intermediate and hingedly interconnecting the support panels along their common longitudinal edge.

According to yet another optional feature of this aspect of the present invention, the support panels are hingedly connected to the adjacent wall panel by one or more bracket panels. The bracket panels may be trapezoidal in shape.

In some embodiments, there may further comprise a pair of gusset panels hingedly connected to said bracket panel and folded out of alignment therewith, wherein said pair of gusset panels hingedly connect said support panels to said bracket panel. The gusset panels are preferably, folded out of alignment with respect to each said support panel so as to abut a wall of the adjacent articles.

According to an optional feature of this aspect of the present invention part of said support panels may each abut a wall of adjacent articles.

According to a second aspect of the invention there is provided blank for wraparound carton comprising a plurality of wall panels hingedly interconnected in series, wherein the wall panels include a pair of base panels at the opposite end to the blank, and wherein one of the base panels is connected to an adjacent wall panel through a beam forming portion that includes a bracket panel hingedly connected to the base panel and a pair of support panels both connected to the bracket panel and extending to said adjacent wall panel.

Preferably an opposing end of the beam forming structure is hingedly connected to a side wall panel. More preferably, the distance between the fold lines hingedly interconnecting the side wall panel and the beam forming structure and top wall respectively in less than the distance between the top and base of the article to be packaged.

Alternatively, the first end of the beam structure is hingedly interconnected to the top wall panel of the carton.

According to an optional feature of this aspect of the invention, the pair of support panels may be separated by a medial panel.

According to another optional feature of this aspect of the present invention, the bracket panels are trapezoidal in shape. Alternatively, the bracket panels are triangular in shape.

According to another optional feature of this aspect of the present invention there further comprises a pair of gusset panels hingedly connected to said bracket panel wherein said pairs of gusset panels hingedly connect said support panels to said bracket panel.

A third aspect of the invention provides a method of forming a carton from the blank comprising the steps of:

(i) introducing an array of articles having a recess defined between adjacent articles, to the blank; (ii) inserting the beam forming portion into the recess to cause the support panels to be folded out of alignment and to engage the walls of the adjacent articles; and (iii) fold the top base panels into overlapping arrangement to be secured together.

BRIEF DESCRIPTION OF THE DRAWINGS

Exemplary embodiments of the invention will now be described, by way of example only, with reference to the accompanying drawings, in which:—

DETAILED DESCRIPTION OF THE PREFERRED EMBODIMENTS

Figure 1:
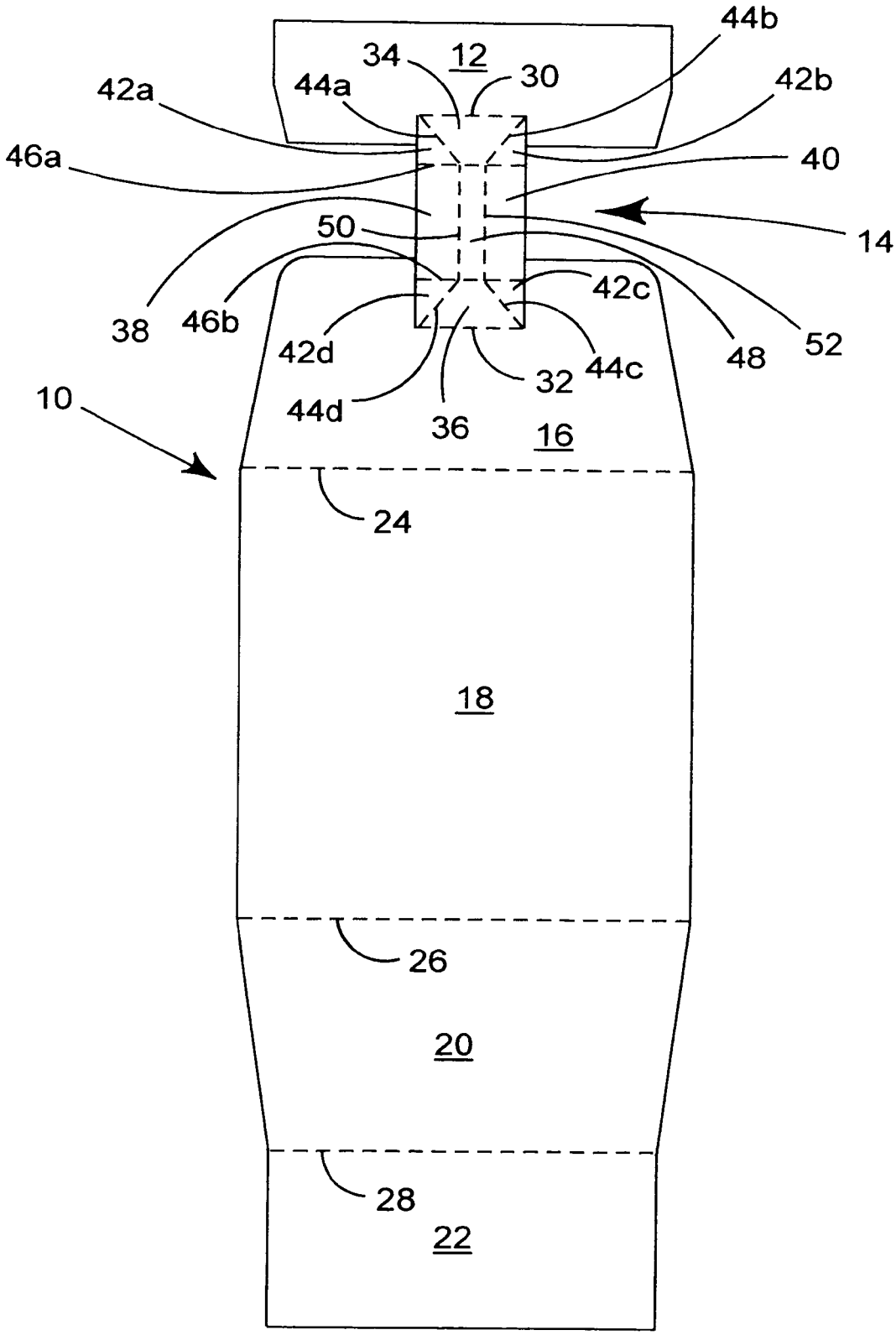
FIG. 1 shows a blank for forming a wraparound carton incorporating a beam structure according to one embodiment of the invention.

Referring to the drawings, and in particular FIG. 1, there is shown one example of a blank 10 made from paperboard or similar foldable sheet material for forming a wraparound carton according to the invention having a plurality of panels for forming a beam structure 14 provided therewith, for packaging one or more articles. The blank comprises in series a plurality of panels for forming a carton having a top, a base and opposed side walls. In this embodiment, there comprises a first base wall panel 12, the beam structure 14, a first side wall panel 16, a top wall panel 18, a second side wall panel 20 and a second base wall panel 12 hingedly interconnected in series along fold lines 30, 32, 24, 26, 28 respectively.

The beam structure 14 extends between, and is hingedly connected to the first base wall panel 12 and first side wall panel 16 via a pair of bracket arrangements. Thus, the beam structure 14 can be interposed between portions of the article(s) to support it. Preferably the beam structure 14 is struck from at least in part the first base panel 12 and first side wall panel 16, so that those parts of the aforesaid panels not forming the beam structure, form part of the external walls.

In this embodiment, each bracket arrangement comprises a bracket panel 34, 36 hingedly connected along one edge to the first base wall panel 12 along fold line 30 and first side wall panel along fold line 32 respectively. Preferably, the bracket panels 34, 36 are substantially trapezoidal in shape and fold lines 30, 32 are provided along their longest edges. Each bracket panel 34, 36 is hinged along each of its opposing oblique side edges to a pair of gusset panels 42*a*, 42*b* and 42*c*, 42*d* along fold lines 44*a*, 44*b*, 44*c*, 44*d* respectively. The gusset panels 42*a*, 42*b*, 42*c*, 42*d* are substantially triangular in shape, in the preferred embodiment of FIG. 1. Of course the shape of the bracket panel and/or gusset panels are not limited to the shapes described above and it is envisaged that other shapes could be used to provide a beam of a substantially inverted "V" shaped cross-section, for example.

Gusset panels 42*a* and 42*b* are hingedly connected along fold line 46*a* to first and second end article support panels 38 and 40 respectively. Likewise, gusset panels 42*c* and 42*d* are hingedly connected along fold line 46*b* to opposite ends of the first and second article support panels 38 and 40 respectively.

In this embodiment, a medial panel 48 separates the article support panels 38, 40 and is hingedly connected thereto along its side edges by fold lines 50, 52. The medial panel 48 is, in the preferred embodiment, hingedly connected to the shortest edge of bracket panels 34 and 36 by fold lines 46*a* and 46*b*.

Figure 2:
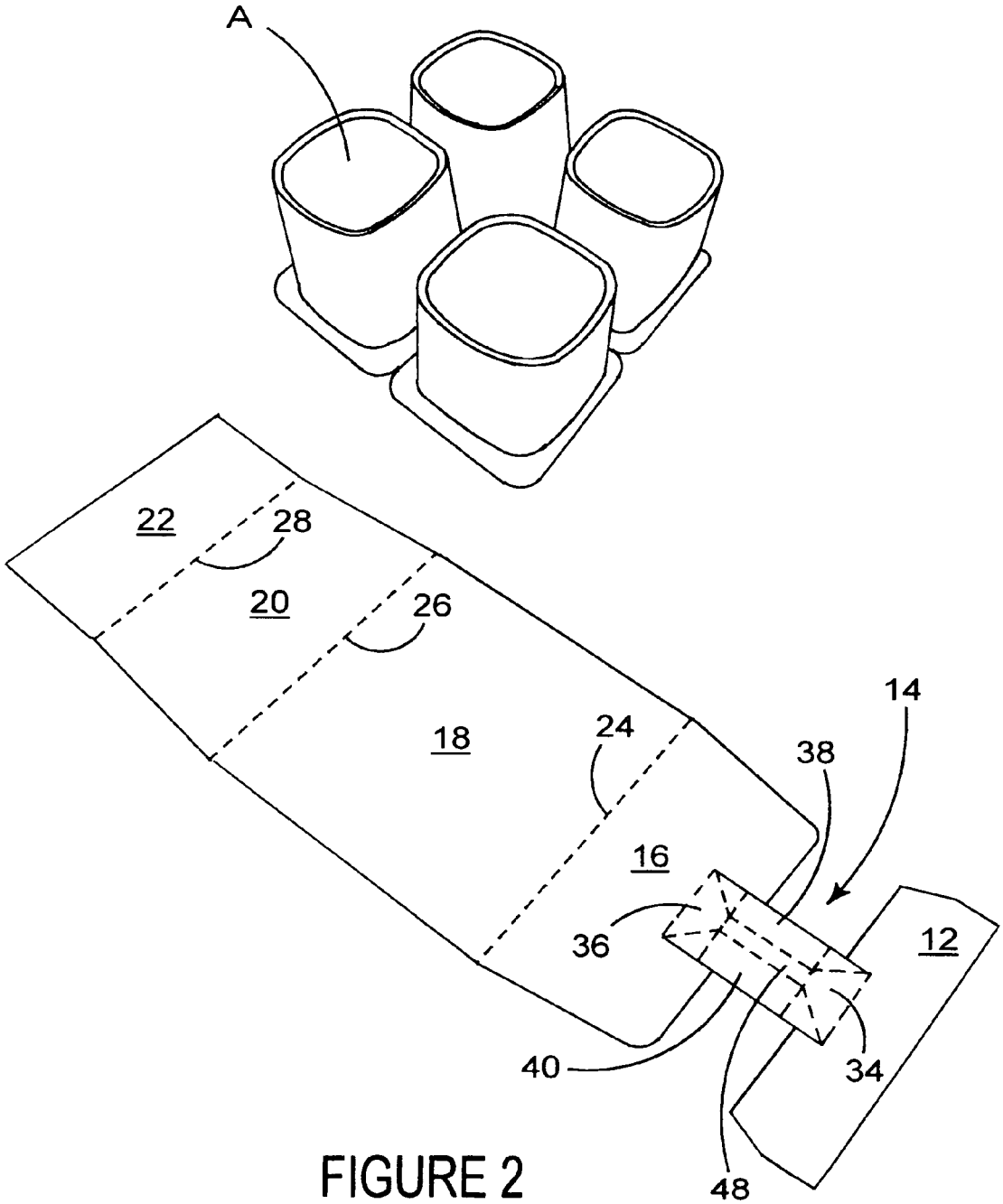
FIG. 2 shows an inverted perspective view of the blank of FIG. 1 shown having an article introduced thereto.
Figure 3:
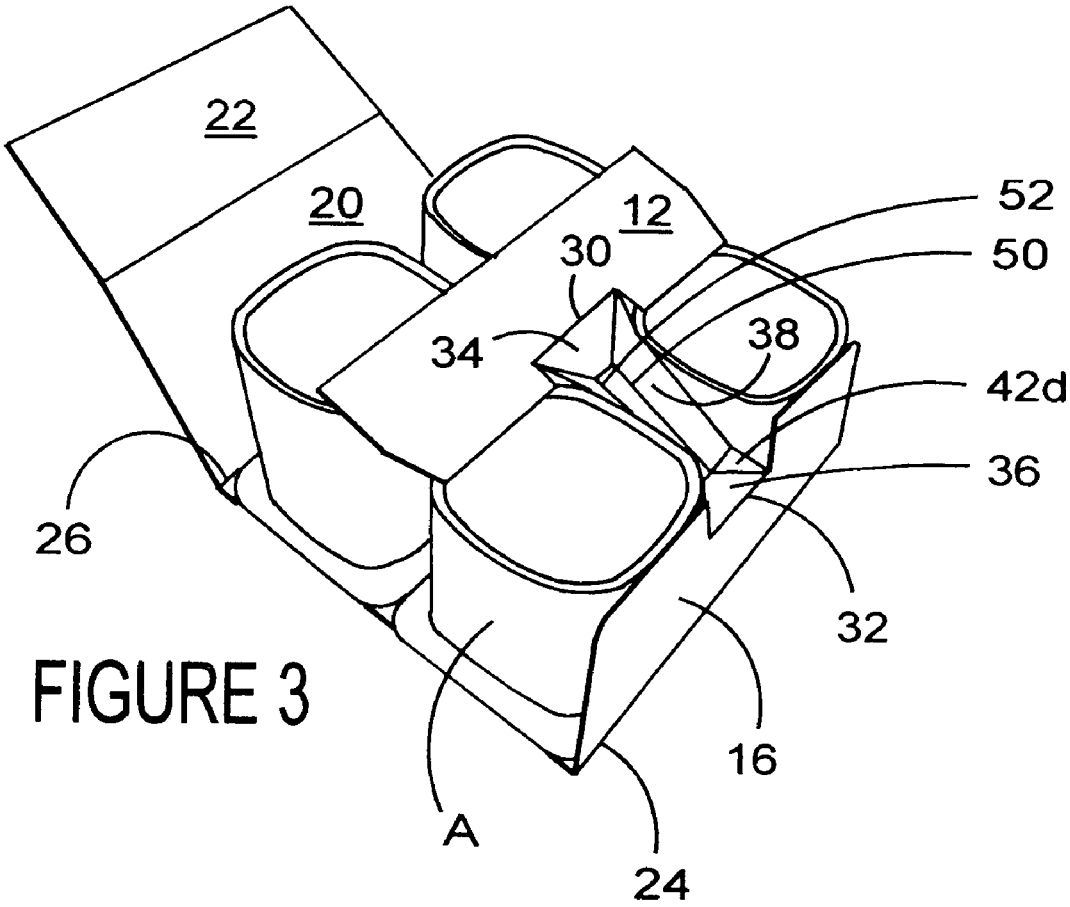
FIGS. 3 and 4 show inverted perspective views of successive stages of the carton erection process.
Figure 4:
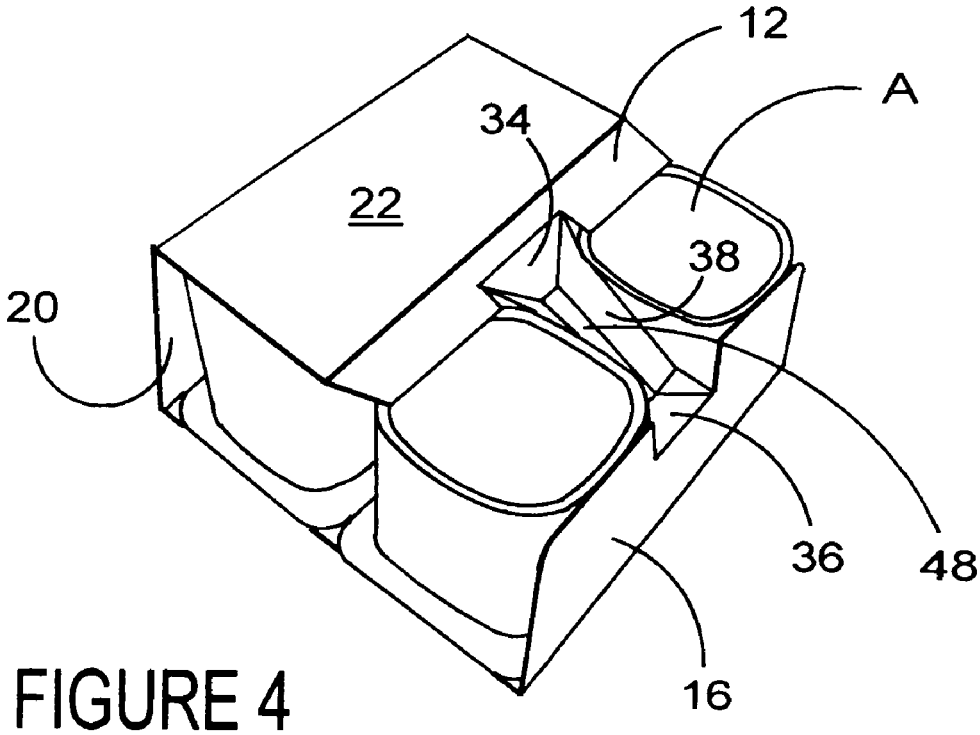

Turning to the construction of the carton illustrated in FIGS. 2, 3 and 4, it is envisaged that the carton of the present invention can be formed by a series of sequential folding and, optionally, gluing operations which can be performed in a known straight line machine so that the carton is not required to be rotated or inverted to complete its construction. The folding process is not limited to that described below and can be altered according to particular manufacturing requirements. The articles are shown inverted for clarity only.

Referring first to FIG. 2, the top wall panel 18 of carton blank 10 is brought into contact with the upper planar face of the articles A by relative vertical motion therebetween. Turning to FIG. 3, the blank 10 is then part erected to provide a pair of oppositely disposed side walls by folding side wall panels 16, 20 inwardly about fold lines 24 and 26. The bracket panels 34, 36 are folded out of alignment with first base wall panel 12 and first side wall panel 16, such that first base wall panel 12 overlies the base of the articles A.

Meanwhile, or contemporaneously, the beam structure 14 is constructed by folding first and second support panels 38, 40 along common fold lines 50, 52 into an angular relationship with each other and with medial panel 48 (FIG. 4), such that medial panel 48 is uppermost. The folding of the first and second support panels 38, 40 simultaneously causes gusset panels 42*a*, 42*b* and 42*c*, 42*d* to be folded out of alignment with bracket panels 34, 36.

Beneficially, the first and second support panels are automatically folded by virtue of the introduction of the beam structure into the gap between adjacent articles A. For this to be achieved, the width of the medial panel 48 is equal to or less than the spacing between adjacent pots but the overall unfolded width of the beam structure 14 is wider than the spacing between pots. The intrinsic resilience of the folded paperboard ensures that a snug fit is maintained between the support panels 38, 40 and the articles.

Second base wall panel 22 is then folded over the base of articles A and is secured to first base wall panel 13 using glue, or other suitable means known in the art, such as mechanical interlocking means, for example thereby, forming a composite base wall. The carton is now fully erected, as shown in FIGS. 4, 5 and 6 with a beam of a substantially inverted "U" shaped cross section.

It is envisaged that the angular relationship between support panels 38 and 40 can be altered by moving fold lines 44*a*, 44*b*, 44*c*, 44*d* and/or fold lines 46*a*, 46*b* according to particular requirements of the beam structure 14. The bracket panels 34, 36 are not limited to being of trapezoidal shape. In other classes of embodiment, it is envisaged that the support panels may be folded upwardly to form a beam of inverted structure. In some embodiments, second base wall panel may be extended to cover the entire base, and may potentially be provided with a flap to be secured to first side wall panel 16.

Figure 5:
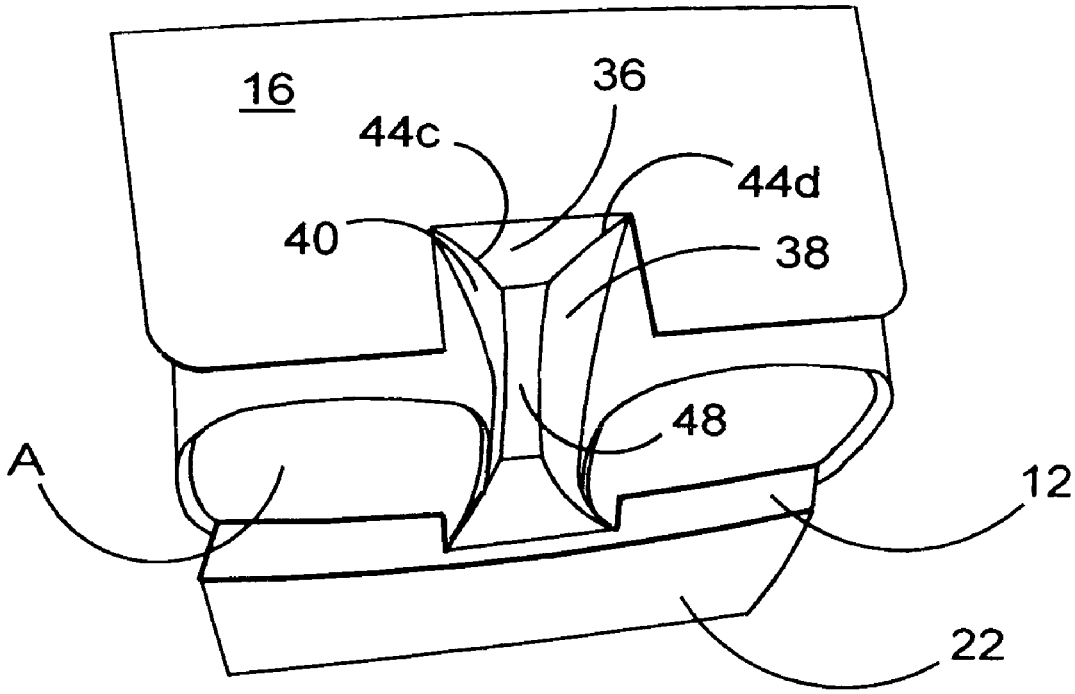
FIGS. 5 and 6 show perspective views a fully erected and loaded carton formed from the blank shown in FIG. 1.
Figure 6:
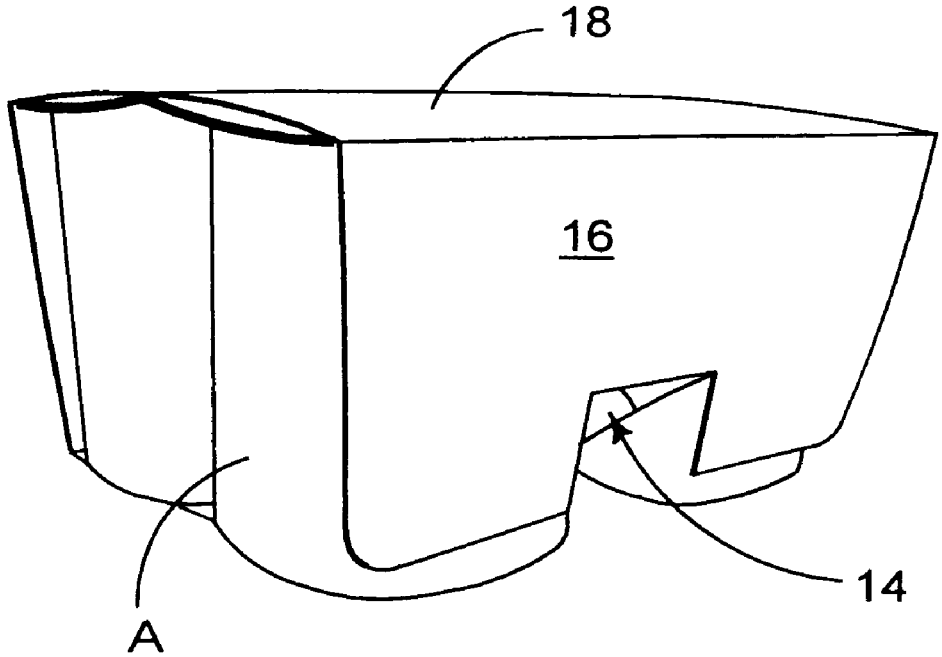

In some embodiments, the beam support panels may flex, shown in FIG. 5, so as to engage the articles to improve rigidity of the carton. In these embodiments the support panels function as engaging strips. Preferably the panels 38, 40 flex along the fold lines 44*a*, 50, 44*d*; and 44*b*, 52, 44*c* and these fold lines may be oriented so as to better confirm to the shape of the adjacent article.

Figure 7:
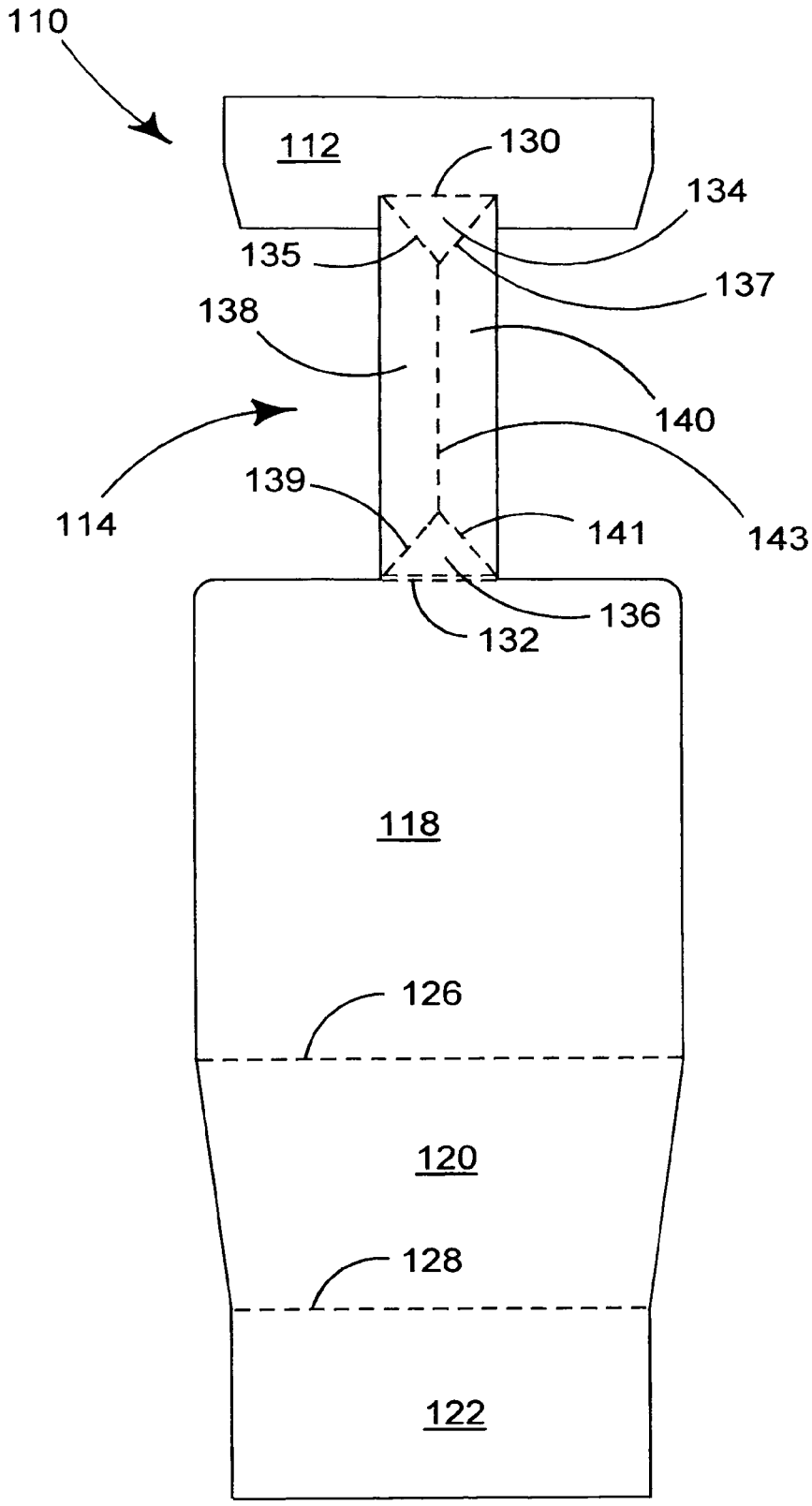
FIG. 7 shows a blank for forming a wraparound carton incorporating a beam structure according to a second embodiment of the invention.
Figure 8:
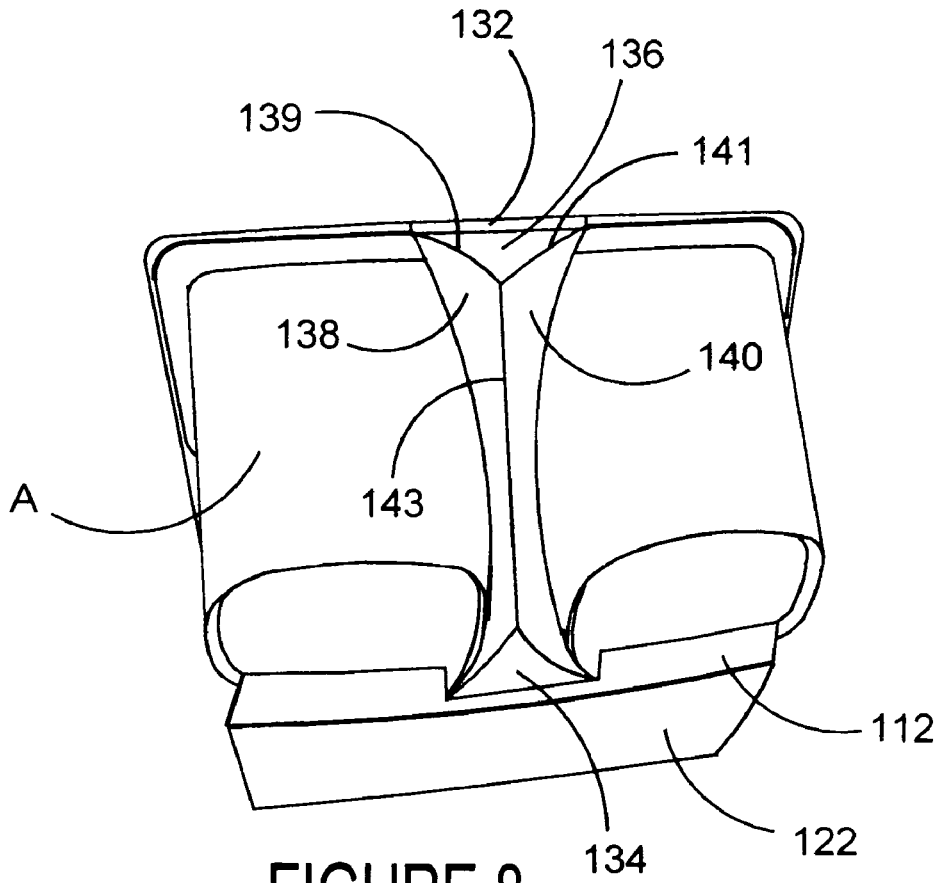
FIGS. 8 and 9 show perspective views a fully erected and loaded carton formed from the blank shown in FIG. 1.
Figure 9:
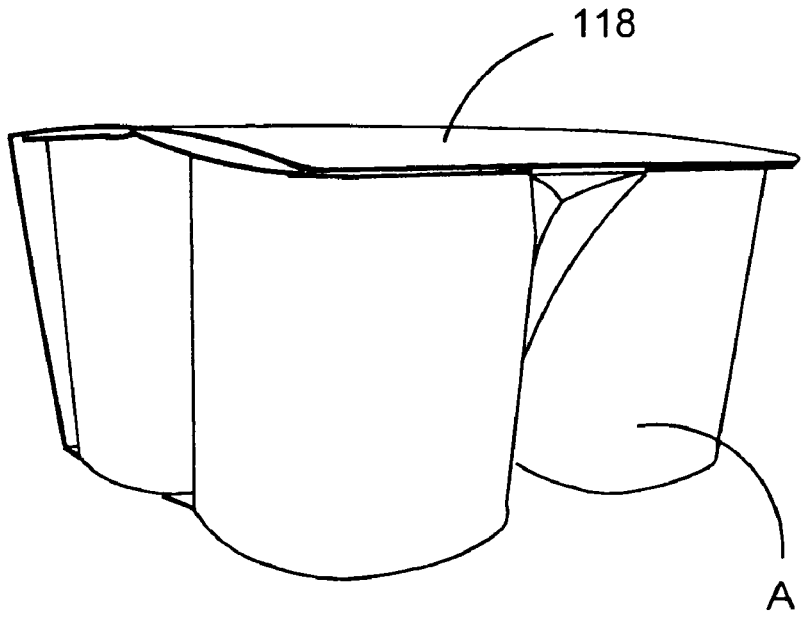

Turning to a second embodiment of the invention as illustrated in FIGS. 7, 8 and 9, like parts have, where possible, been represented by like numerals with the addition of the pre-fix "1". The second embodiment is similar to the first embodiment, so only the differences are described in any greater detail.

Referring in particular to the blank 110 as illustrated in FIG. 7, this embodiment differs from the first embodiment in that the first side wall panel has been omitted and the beam structure 114 is thus hingedly interconnected directly to top wall panel 18 along fold line 132. Additionally, the beam structure has been extended in length to compensate for the omission of the first side wall panel.

Turning to the beam structure 114 in more detail, it can be seen that in this embodiment support panels 138 and 140 are mutually hingedly connected along a common fold line 143 and further, that the gusset panels have been omitted such that support panels 138 and 140 are trapezoidal in shape and are directly hingedly interconnected to bracket panels 134 and 136 along fold lines 135, 139 and 137, 141 respectively.

Turning to the construction of the carton to form a fully set up carton as illustrated in FIGS. 8 and 9, it is again envisaged that the carton of the second embodiment can be formed by a series of sequential folding and gluing operations which can be performed in a straight line machine so that the carton is not required to be rotated or inverted to complete its construction.

The folding operation is substantially as described in the first embodiment and results in the blank forming a tubular carton encircling the articles A. Thereafter, first and second base wall panels 112 and 122 being secured together using glue or other suitable means known in the art to form a composite base wall as shown in FIG. 8.

The beam structure 114 is constructed by folding first and second support panels 138 and 140 along their common fold line 143 into an angular relationship with each other such that the fold line 143 is uppermost, in this embodiment.

Beneficially, the first and second support panels are automatically folded by virtue of the introduction of the beam structure 114 into the gap between adjacent articles A. For this to be achieved, the width of the support panels 138, 140 when in a co-planar state are wider than the space inbetween pots. Again, the intrinsic resilience of the folded paperboard ensures that a snug fit is maintained between the support panels 138, 140 and the articles.

It will be appreciated by those skilled in the art that the combination of a wraparound arrangement with a inclined beam interposed between articles substantially prevents the relative movement of the articles A and carton which may otherwise compromise the automated handling of the cartons and the stacking thereof. Thus, the beam arrangement may be used to replace end retention means which have hitherto been used to prevent relative horizontal movement between articles and carton, but which generally require an additional folding step to be carried out as part of the erection process.

It will be recognized that as used herein, the terms "top", "base", "side", "upper" and "lower" with respect to the panels of the carton are relative terms, and that the carton may be re-oriented as necessary or as desired. Any reference to hinged connections should not be construed as necessarily referring to a single fold line only; indeed it is envisaged that a hinged connection can be formed from a score line, a frangible line or one, two or more fold lines without departing from the scope of invention.

The present invention and its preferred embodiment relates to a beam structure in a wraparound carton which is shaped to provide satisfactory strength to hold at least one article securely but with a degree of flexibility so that the load transferred to the beam structure is absorbed by the carton. The shape of the blank minimizes the amount of paperboard required. The carton can be applied to an array of articles by hand or automatic machinery.

What is claimed is:

1. A package, comprising:

a wraparound carton; and a plurality of articles arranged with a recess defined between adjacent ones of said articles, said articles being packaged in said carton, said articles being interconnected to provide an upper planar face of said articles;

said carton comprising a top wall, a side wall, a base wall, and a beam structure arranged to form a tubular structure that encircles said articles, said top wall being disposed in contact with said upper planar face, a longitudinal axis of said beam structure being inclined to the plane of said top wall, said beam structure comprising:

first and second opposite ends, wherein said beam structure is arranged to be placed in said recess and is hingedly connected at said first opposite end to said base wall;

at least one medial fold line extending along the length of said beam structure; and at least one angled fold line extending between an end of said at least one medial fold line and one of said opposite ends of said beam structure.

2. The package of claim 1 wherein said second opposite end of said beam structure is hingedly connected to said top wall.

3. The package of claim 1 wherein said beam structure comprises a pair of support panels hingedly connected along said at least one medial fold line.

4. The package of claim 3 wherein said support panels are folded along said at least one medial fold line to define an angle therebetween and facilitate formation of said beam.

5. The package of claim 1 wherein said beam structure comprises a pair of support panels and a medial panel, the medial panel being intermediate and hingedly interconnecting said support panels along said at least one medial fold line.

6. The package of claim 3 wherein said support panels are hingedly connected to a bracket panel along said at least one angled fold line, said bracket panel being hingedly connected to said base wall.

7. The package as claimed in claim 6 wherein said bracket panel is triangular in shape.

8. The package of claim 5 wherein said support panels are hingedly connected to a bracket panel along said at least one angled fold line, said bracket panel being hingedly connected to said base wall.

9. The package as claimed in claim 8 wherein said bracket panel is trapezoidal in shape.

10. The package as claimed in claim 8 wherein said beam structure further comprises a pair of gusset panels hingedly connected to said bracket panel and folded out of alignment therewith, wherein said gusset panels hingedly connect said support panels to said bracket panel.

11. The package as claimed in claim 10 wherein said gusset panels are folded out of alignment with respect to each of said support panels so as to abut walls of said adjacent articles.

12. The package as claimed in claim 3 wherein said support panels each at least in part abut a wall of a respective one of said adjacent articles.

13. The package as claimed in claim 5 wherein said support panels each at least in part abut a wall of a respective one of said adjacent articles.

14. The package of claim 1 wherein said base wall comprises a pair of first and second base wall panels secured together, and said beam structure is connected at said first opposite end to one of said base wall panels.

15. The package of claim 14 wherein said first base wall panel is hingedly connected to said first side wall, and said second base wall panel is connected to said first opposite end of said beam structure.

16. A package, comprising:

a wraparound carton; and a plurality of articles arranged with a recess defined between adjacent ones of said articles, said articles being packaged in said carton;

said carton comprising a top wall, a side wall, a base wall, and a beam structure arranged to form a tubular structure that encircles said articles, said beam structure comprising:

first and second opposite ends, wherein said beam structure is arranged to be placed in said recess and is hingedly connected at said first opposite end to said base wall;

at least one medial fold line extending along the length of said beam structure; and at least one angled fold line extending between an end of said at least one medial fold line and one of said opposite ends of said beam structure, wherein said carton is provided with a second side wall, and wherein said second opposite end of said beam structure is hingedly connected to said second side wall.

17. The package of claim 16 wherein said second opposite end is hingedly connected to said second side wall at an elevation intermediate said top wall and said base wall.

18. A blank for forming a wraparound carton, comprising a plurality of wall panels hingedly interconnected in series, wherein said wall panels include a pair of base wall panels at opposite ends of the blank, and wherein one of said base wall panels is connected to an adjacent wall panel through a beam forming portion, said beam forming portion comprising:

first and second opposite ends;

at least one medial fold line extending along the length of said beam forming portion;

at least one angled fold line extending between an end of said at least one medial fold line and one of said opposite ends of said beam forming portion; and a bracket panel disposed at least one of said opposite ends of said beam forming portion and being defined at least in part by said at least one angled fold line, said first opposite end of said beam forming portion being hingedly connected to said one base wall panel and a second opposite end of said beam forming portion extending to said adjacent wall panel wherein said second opposite end of said beam forming portion is hingedly connected to said adjacent wall panel along a first fold line, wherein said wall panels further include a first side wall panel hingedly connected to the other base wall panel along a second fold line, a top wall panel hingedly connected to said first side wall panel along a third fold line, and a second side wall panel hingedly connected to said top wall panel along a fourth fold line, said adjacent wall panel is said second side wall panel, and the distance between said first and fourth fold lines is less than the distance between said second and third fold lines.

19. The blank of claim 18 wherein said bracket panel disposed at least one of said opposite ends of said beam forming portion and being defined at least in part by said at least one angled fold line comprises a bracket panel disposed at each of said opposite ends, said beam forming portion further comprising a pair of support panels disposed between said bracket panels.

20. The blank of claim 19 wherein said beam forming portion further includes a medial panel interposed between said support panels and between said bracket panels, the medial panel being hingedly connected to each of said support panels along said at least one medial fold line.

21. The blank of claim 20 wherein at least one of said bracket panels is trapezoidal in shape.

22. The blank of claim 18 wherein at least one of said bracket panels is triangular in shape.

23. The blank of claims 20 wherein said beam forming portion further includes at least one gusset panel, said at least one gusset panel interconnecting one of said bracket panels with one of said support panels.

24. A method of forming a carton from said blank of claim 18 comprising the steps of:

(i) introducing an array of articles having a recess defined between adjacent ones of said articles, to said blank;

(ii) bringing said top wall panel into contact with an upper planar face of said articles by relative vertical motion between said blank and said array;

(iii) inserting said beam forming portion into said recess to cause said support panels to be folded out of alignment and to engage walls of said adjacent articles; and (iv) folding said base wall panels into overlapping arrangement to be secured together.

25. A wraparound carton, comprising;

a plurality of wall panels hingedly interconnected in series to form a tubular structure; wherein said wall panels include a pair of base wall panels secured together in an overlapping relationship; and wherein one of said base wall panels is connected to an adjacent wall panel through a beam structure; said beam structure comprising:

first and second opposite ends;

at least one medial fold line extending along the length of said beam structure;

at least one angled fold line extending between an end of said at least one medial fold line and one of said opposite ends of said beam structure; and a bracket panel disposed at least one of said opposite ends of said beam structure and defined at least in part by said at least one angled fold line; said first opposing end of said beam structure being hingedly connected to said one base wall panel and said second opposing end of said beam structure extending to said adjacent wall panel, said beam structure having a longitudinal axis that is inclined to each of said wall panels.

26. The carton of claim 25 wherein said second end of said beam structure is hingedly connected to said adjacent wall panel along a first fold line.

27. The carton as claimed in claim 26 wherein said wall panels further include a first side wall panel hingedly connected to and extending upwardly from the other base wall panel, a top wall panel hingedly connected to said first side wall panel and disposed above said base wall panels, and a second side wall panel hingedly connected to and extending downwardly from said top wall panel, said adjacent wall panel is said second side wall panel, and the distance between said first fold line and said top wall panel is less than the distance between said top wall panel and said base wall panels.

28. The carton as claimed in claim 26 wherein said wall panels further include a side wall panel hingedly connected to and extending upwardly from the other base wall panel, and a top wall panel hingedly connected to said side wall panel and disposed above said base wall panels, and said adjacent wall panel is said top wall panel.

29. The carton of claim 25 wherein said bracket panel disposed at least one of said opposite ends of said beam structure comprises a pair of bracket panels disposed at each of said opposite ends of said beam structure, and wherein a pair of support panels is disposed between said bracket panels.

30. The carton of claim 29 wherein said beam structure further includes a medial panel interposed between said support panels and between said bracket panels, the medial panel being hingedly connected to each of said support panels along said at least one medial fold line.

31. The carton of claim 30 wherein at least one of said bracket panels is trapezoidal in shape.

32. The carton of claim 25 wherein at least one of said bracket panels is triangular in shape.

33. The carton of claim 30 wherein said beam structure further includes at least one gusset panel, said at least one gusset panel interconnecting one of said bracket panels with one of said support panels.

* * * * *